US005803585A

United States Patent [19]

Littman et al.

[11] Patent Number: 5,803,585

[45] **Date of Patent: *Sep. 8, 1998**

[54] ADJUSTABLE LIGHT FIXTURE

[75] Inventors: Eugene Littman, Newburgh; Steven Proner, Hurley; Barry D. White, Newburgh; Douglas Highbridge, New Paltz, all of N.Y.

[73] Assignee: Lightron of Cornwall Incorporated, New Windsor, N.Y.

[ * ] Notice: The term of this patent shall not extend beyond the expiration date of Pat. No. 5,564,815.

[21] Appl. No.: 705,729

[22] Filed: Aug. 30, 1996

Related U.S. Application Data

[63] Continuation of Ser. No. 267,611, Jun. 29, 1994, Pat. No. 5,564,815.

[51] Int. Cl.[6] ..... F21V 21/04

[52] U.S. Cl. ..... 362/147; 362/287; 362/365; 362/220

[58] Field of Search ..... 362/220, 148, 362/150, 364, 365, 217, 285, 287, 372, 250, 232, 288, 147, 418

[56] References Cited

U.S. PATENT DOCUMENTS

| | | | |
|---|---|---|---|
| 2,740,885 | 4/1956 | Kruger . | |
| 3,287,552 | 11/1966 | Drandell | 362/233 |
| 3,643,086 | 2/1972 | Shaw | 362/364 |
| 3,702,928 | 11/1972 | Alger | 362/804 |
| 4,161,019 | 7/1979 | Mulvey | 362/147 |
| 4,171,535 | 10/1979 | Westermann | 362/148 |
| 4,204,274 | 5/1980 | Luderitz | 362/287 |
| 4,287,554 | 9/1981 | Wolff . | |
| 4,419,717 | 12/1983 | Price et al. | 362/148 |
| 4,454,569 | 6/1984 | Maguire | 362/127 |
| 4,511,954 | 4/1985 | Marcus et al. | 362/287 |
| 4,716,504 | 12/1987 | Pahl | 362/365 |
| 4,729,080 | 3/1988 | Fremont et al. | 362/365 |
| 4,739,454 | 4/1988 | Federgreen | 362/217 |
| 4,779,178 | 10/1988 | Spitz | 362/220 |
| 4,855,886 | 8/1989 | Eijkelenboom et al. | 362/217 |
| 4,935,854 | 6/1990 | Kernodle | 362/220 |
| 4,947,297 | 8/1990 | Druffel et al. | 362/147 |
| 4,967,324 | 10/1990 | Barclay | 362/147 |
| 5,145,249 | 9/1992 | Bruckner | 362/365 |
| 5,268,824 | 12/1993 | Czipiri | 362/287 |
| 5,289,358 | 2/1994 | Halemeier | 362/365 |
| 5,609,408 | 3/1997 | Targetti | 362/364 |

FOREIGN PATENT DOCUMENTS

| | | | |
|---|---|---|---|
| 950361 | 10/1956 | Germany | 362/365 |
| 457330 | 8/1988 | Switzerland | 362/365 |
| 732057 | 6/1955 | United Kingdom | 362/364 |

OTHER PUBLICATIONS

Engineered Lighting Products, El Monte, California; AK Series Recessed Wall Washer, Yoke Mounted Wall Washer, Recessed Low Level Flood Light; 1992.

elliptipar advertisement; Architectural Record Lighting, p. 7, May 1995.

indy Lighting (Juno Lighting), Fishers, Inc.; Compact Fluorescent Wallwash/Flood Track Fixture 701T, Compact Fluorescent Recessed Wallwash/Accent 714R.

SPI, Lighting, Inc., EDR–ECR–SR–1733 Fixture.

Adjustable Par 38 Elbow, Series PDA–6, Lightron of Cornwall, Inc. catalog sheet (Sep. 1992).

ellipitipar, inc. advertisement, Lighting Design & application, Vo. 23, No. 9, p. 35 (Sep. 1993).

*Primary Examiner*—Thomas M. Sember

*Attorney, Agent, or Firm*—Fish & Richardson P.C.

[57] ABSTRACT

A lamp assembly is oriented inside a mounting structure to direct illumination out of an opening in the mounting structure. A coupling is selectively engageable to fix the orientation of the lamp assembly, and selectively disengageable by accessing it through the opening to change the orientation of the lamp assembly. The coupling may comprise a latching assembly that can be selectively engaged to fix the orientation of the lamp assembly at a plurality of predetermined discrete orientations. A stop may be carried by the mounting structure to prevent the lamp assembly from pivoting through the opening.

17 Claims, 13 Drawing Sheets

ADJUSTABLE LIGHT FIXTURE

This is a continuing application of U.S. application Ser. No. 08/267,611, filed Jun. 29, 1994, now U.S. Pat. No. 5,564,815 and entitled "Adjustable Light Fixture".

BACKGROUND OF THE INVENTION

This invention relates to electrical light fixtures, and in particular to light fixtures for supporting elongated lamps such as fluorescent lamps.

Light fixtures for supporting elongated lamps such as fluorescent lamps typically include a housing that can be either mounted in or hung from a ceiling. Generally, the lamp is supported with its longitudinal axis oriented horizontally, and a reflector mounted above the lamp projects light from the lamp vertically downward to illuminate an area directly below the fixture.

SUMMARY OF THE INVENTION

In a general aspect of the invention, a lamp assembly for supporting at least one elongated lamp is pivotally attached to a mounting structure so that the lamp assembly is rotatable with respect to the mounting structure about an axis generally aligned with a longitudinal axis of the lamp.

Among other advantages, the lamp assembly can be rotated continuously through a range of angles to change the direction of the illumination provided by the elongated lamp. The elongated lamp may have characteristics—such as color, intensity, and energy efficiency—well-suited to a particular lighting application.

In a particularly useful embodiment, a friction assembly attached to the lamp assembly is disposed in a slot in a curved bracket attached to the mounting structure. The friction assembly provides a slidable frictional interface with the bracket. In particular, the friction assembly includes first and second bearings (e.g., nylon washers) disposed on opposite sides of the bracket, and a spring that urges the first bearing toward the second. The spring force may be adjusted to vary the force on the first bearing (and thus also the frictional force between the bearings and the bracket). A ballast for the elongated lamp (e.g., a fluorescent lamp) attaches to the mounting structure so as not to rotate with the lamp assembly. Mounts (e.g., t-bar clips or adjustable flange units) in the mounting structure enable the light fixture to be attached to a ceiling, and the lamp assembly is pivotally attached to the mounting structure by a hinge extending substantially along the length of the lamp assembly.

In another aspect of the invention, an otherwise substantially enclosed housing has an opening through which a lamp assembly pivotally attached to the housing may rotate, and a friction assembly attached to the lamp assembly provides a slidable frictional interface with the housing.

Among other advantages of this aspect of the invention, the housing reduces the amount of foreign matter that enters the interior of the light fixture. Thus, the friction assembly and the pivot mechanism are less likely to become fouled with dust, dirt, or other extraneous matter.

In a particularly useful embodiment of this aspect of the invention, the housing includes an adjustment hole disposed such that the friction assembly aligns with the hole as the lamp assembly rotates through the opening.

In another aspect of the invention, a lamp assembly is oriented inside a mounting structure to direct illumination out of an opening in the mounting structure. A coupling is selectively engageable to fix the orientation of the lamp assembly, and selectively disengageable by accessing it through the opening to change the orientation of the lamp assembly.

The coupling, when engaged to fix the orientation of the lamp assembly with respect to the mounting structure, guards against unintended movement of the lamp assembly, such as might occur under the force of gravity and/or if the lamp assembly were bumped or vibrated. By selectively disengaging the coupling, the direction of illumination cast through the opening in the mounting structure can be changed by changing the orientation of the lamp assembly. The light fixture can also be installed, e.g., so that the opening in the mounting structure lies flush with a wall or ceiling. Because the coupling can be selectively disengaged by accessing it through the opening, the orientation of the lamp assembly can be readily changed, even after installation.

In preferred embodiments, the coupling comprises a hinge and a latching assembly. The latching assembly includes a pin that is movably attached to the lamp assembly and spring-biased towards a series of regularly spaced holes in the mounting structure. The holes are configured to be engaged by the pin, allowing the latching assembly to fix the orientation of the lamp assembly at a plurality of predetermined discrete orientations.

In another aspect of the invention, a lamp assembly is oriented inside a mounting structure to direct illumination out of an opening in the mounting structure. A coupling permits the lamp assembly to be moved with respect to the mounting structure, and a latching assembly can be selectively engaged to fix the orientation of the lamp assembly at a plurality of predetermined discrete orientations.

Not only can the direction of illumination cast through the opening be changed by moving the lamp assembly, but the orientation of the lamp assembly can be fixed at any one of several predetermined discrete orientations by selectively engaging the latching assembly. The predetermined orientations might correspond to a set of desired illumination directions specifically tailored for a particular application or applications, or might instead be a series of regularly spaced positions. In either case, the latching assembly facilitates rapid, positive repositioning and fixing of the lamp assembly. Thus, if several light fixtures of this type are used to illuminate a room or other region, all of the fixtures can readily be set to the same illumination angle.

In another aspect of the invention, a lamp assembly including at least one elongated lamp and an elongated reflector is oriented inside a mounting structure to direct illumination out of an opening in the mounting structure. A coupling permits the lamp assembly to be pivoted about an axis parallel to and spaced apart from the lamp axis, and a stop carried by the mounting structure prevents the lamp assembly from pivoting through the opening.

By preventing the lamp assembly from pivoting through the opening, the stop maintains the lamp assembly well-protected within the mounting structure, which is usually recessed into a wall or ceiling so that the opening lies flush with the mounting surface. The lamp assembly and the delicate elongated lamp are thus less likely to damage or be damaged by passersby or other passing objects. Because it is prevented from pivoting through the opening, the lamp assembly is also less likely to "break" or interrupt the often smooth, relatively unbroken planar appearance of the surface into which the fixture is mounted.

In preferred embodiments, the stop is a region of the mounting structure disposed adjacent the opening, and the lamp assembly is configured to engage the region. Additionally or alternatively, the stop can comprise a region of a limited-rotation hinge.

Other features and advantages of the invention will become apparent from the following detailed description, and from the claims.

DESCRIPTION OF THE PREFERRED EMBODIMENTS

Figure 1:
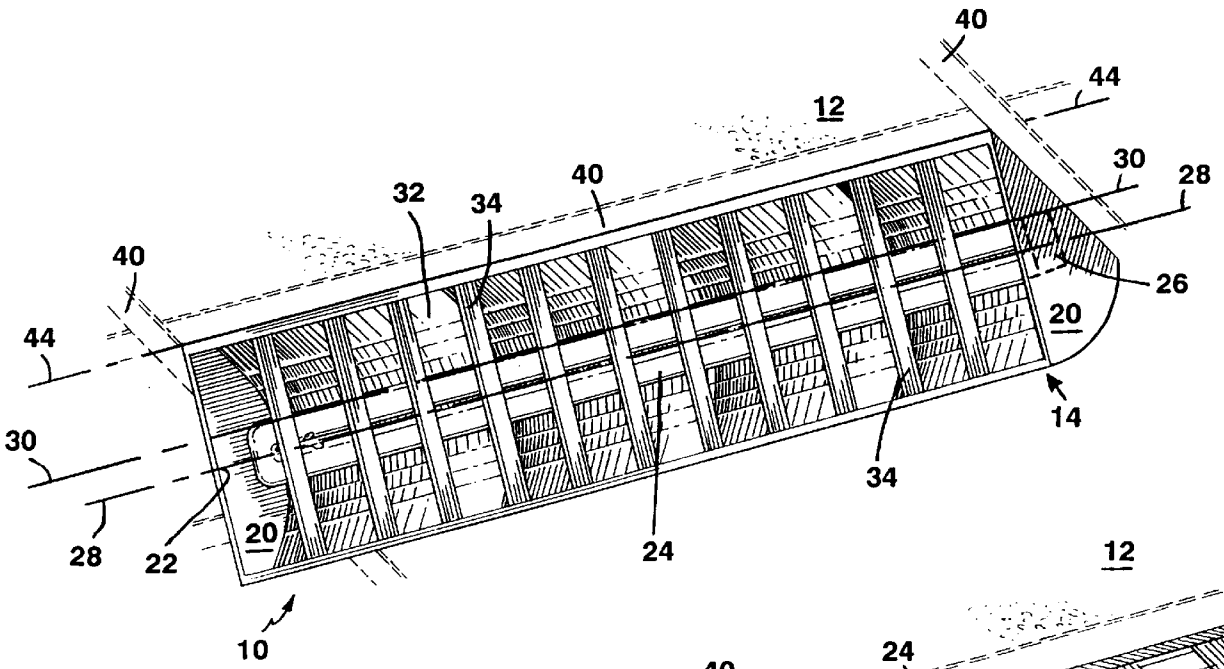
FIG. 1 is a perspective view of a light fixture installed in a suspended ceiling with a lamp assembly fully rotated.
Figure 3:
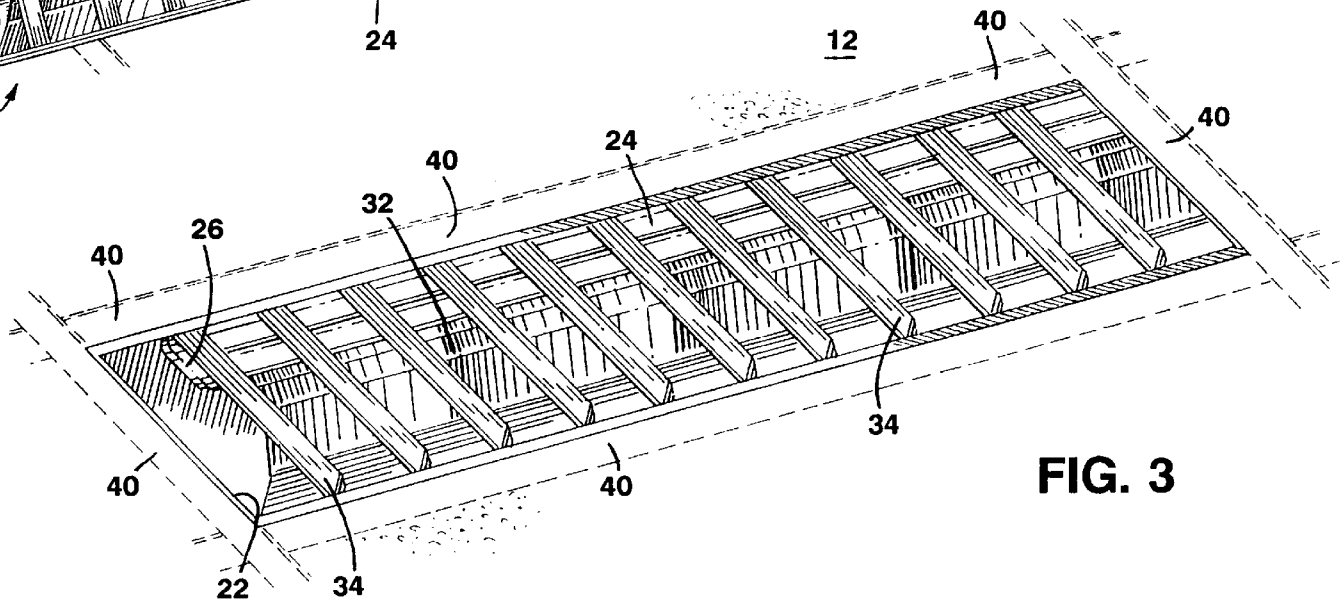
FIG. 3 is a perspective view of the light fixture of FIG. 1 with the lamp assembly fully recessed into the light fixture.
Figure 2:
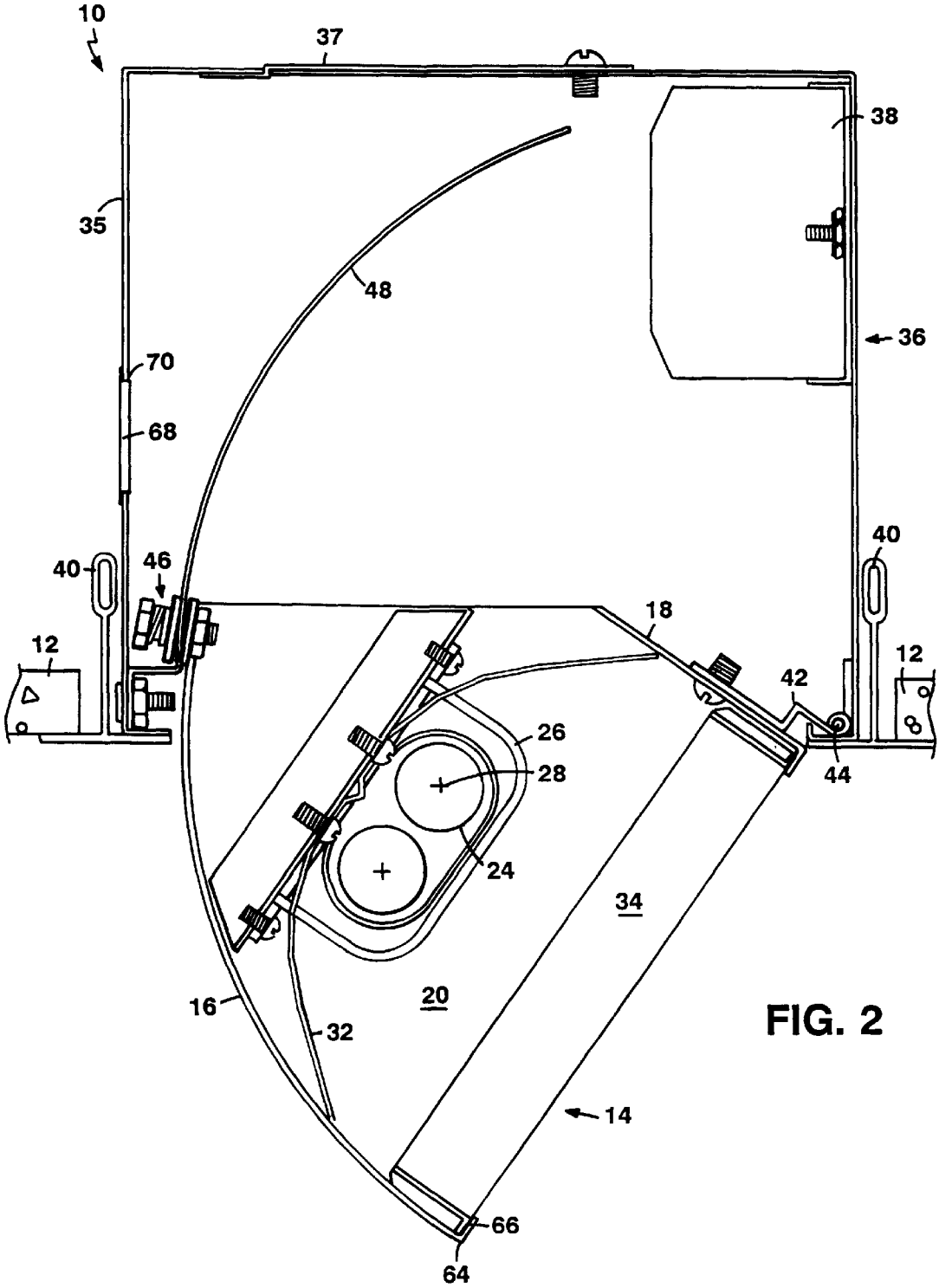
FIG. 2 is a cross-sectional view of the light fixture in the rotational orientation shown in FIG. 1.
Figure 4:
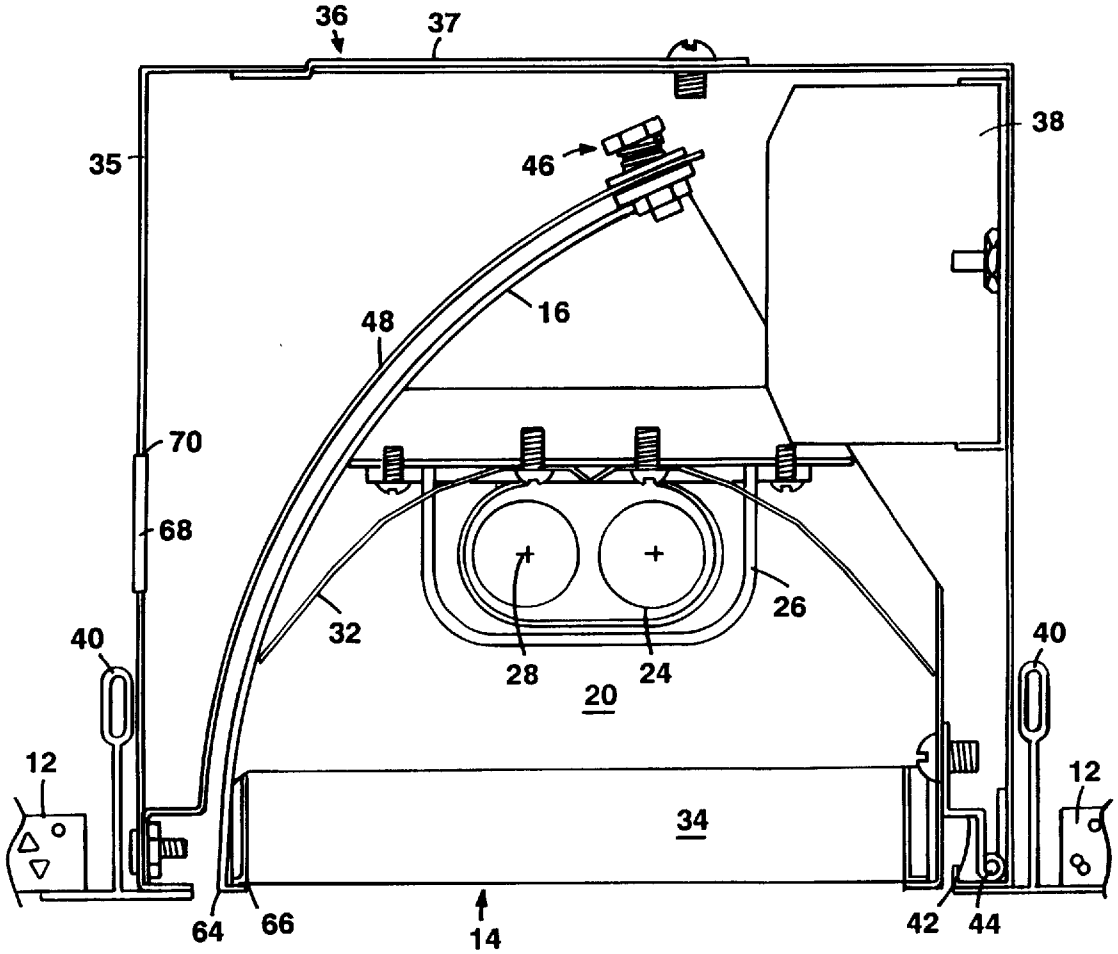
FIG. 4 is a cross-sectional view of the light fixture in the rotational orientation shown in FIG. 3.
Figure 5:
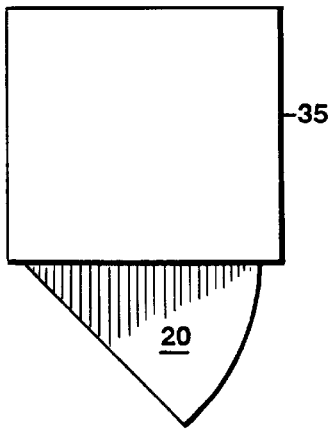
FIG. 5 is a schematic end view of the light fixture in the rotational orientation shown in FIG. 1.

As shown in FIGS. 1–4, an adjustable light fixture 10 installed in a suspended ceiling 12 includes a rotatable lamp assembly 14. As discussed below, lamp assembly 14 may be continuously rotated, with respect to ceiling 12, from the fully recessed orientation shown in FIGS. 3 and 4 to the fully rotated orientation shown in FIGS. 1 and 2. Lamp assembly 14, which is roughly a quarter-circle in cross-section, comprises a constant-radius curved wall 16 disposed opposite a flat wall 18. Walls 16, 18, which extend along the length of light fixture 10, are joined together at their respective ends by end sections 20 (FIG. 5). The edges of walls 16, 18 and end sections 20 together define a rectangular opening 22.

A lamp 24, such as a 40 watt biaxial fluorescent lamp, is installed in a lamp socket 26 in lamp assembly 14. Lamp socket 26 is oriented such that the longitudinal axis 28 of lamp 24 is aligned parallel to the longitudinal axis 30 of lamp assembly 14. Accordingly, lamp assembly 14 is sized to accommodate elongated lamps, i.e. lamps having a length greater than their width or diameter. For example, lamp assembly 14 is 6 in. (15.24 cm.) wide and 24 in. (60.96 cm.) long. A reflector 32 installed behind lamp 24 directs light from lamp 24 out of opening 22, and a series of baffles 34 disposed at regular intervals (e.g., every 2 in. (5.08 cm.)) in opening 22 reduces glare caused by lamp 24.

Figure 6:
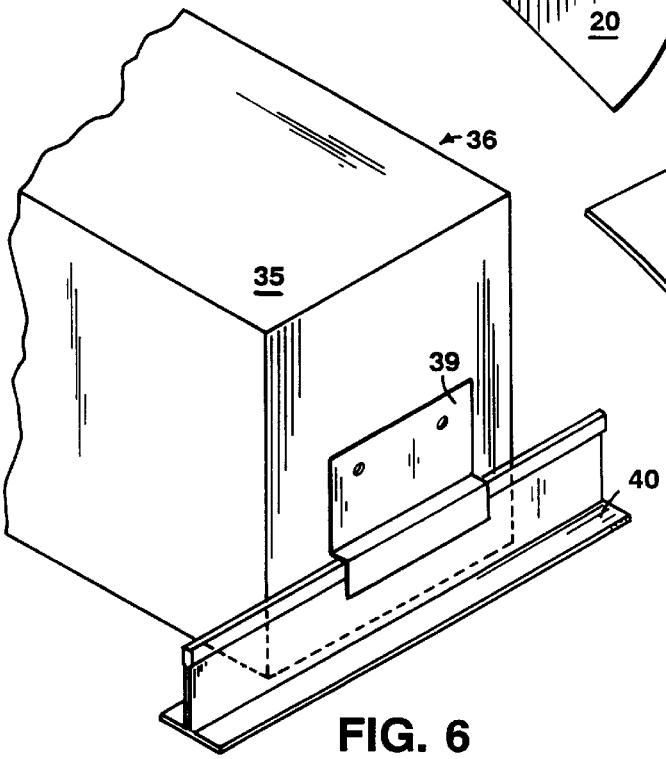
FIG. 6 is a schematic perspective view of an end of a housing of the light fixture.

A fixture housing 36, which at least partially encloses lamp assembly 14, comprises an elongated box 35, generally square in cross-section, that is closed at its ends and three of its sides. Fixture housing 36 is constructed of a rigid material. For example, housing 36 is die-formed of 20 GA steel. An access plate 37 at the top of housing 36 may be removed to wire lamp socket 26 to a ballast unit 38, and to wire ballast unit 38 to an external power supply (not shown). Because ballast unit 38 mounts to the inside wall of box 35, its weight does not affect the rotation of lamp assembly 14. As shown in FIG. 6, a z-shaped t-bar clip 39 welded to each end of housing 36 (only one end of housing 36 shown in FIG. 6) attaches to t-bars 40, which support suspended ceiling tiles 12 in a conventional manner.

A hinge 42, e.g., a continuous 18 GA piano hinge extending the length of fixture 10, is bolted to the corner of lamp assembly 14 disposed farthest from curved wall 16, and welded to housing 36. Hinge 42, which is located at or near the radial center of curved wall 16, allows lamp assembly 14 to be pivoted about an axis 44 with respect to housing 36. Thus, the axis of rotation 44 of lamp assembly 14 is generally aligned with (e.g., is parallel to) the longitudinal axis 28 of lamp 24.

Figure 7:
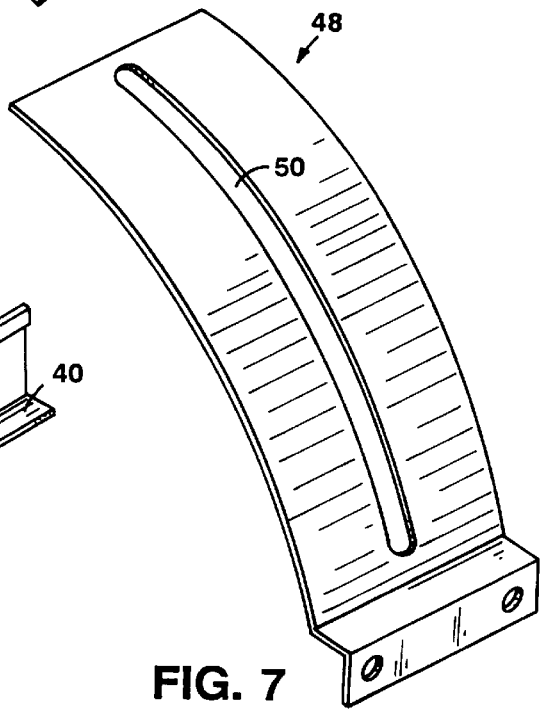
FIG. 7 is a perspective view of a curved guide plate of the light fixture.

The rotational orientation of lamp assembly 14 with respect to housing 36 is maintained by a friction assembly 46 acting in concert with a curved guide plate 48. Guide plate 48, which has a radius of curvature approximately equal to that of curved wall 16, bolts to the edge of housing 36 disposed opposite hinge 42. When it is installed, the radial center of guide plate 48 lies at or near the axis of rotation 44 of lamp assembly 14. As shown in FIG. 7, a slot 50 extends substantially the entire length of guide plate 48.

Figure 8:
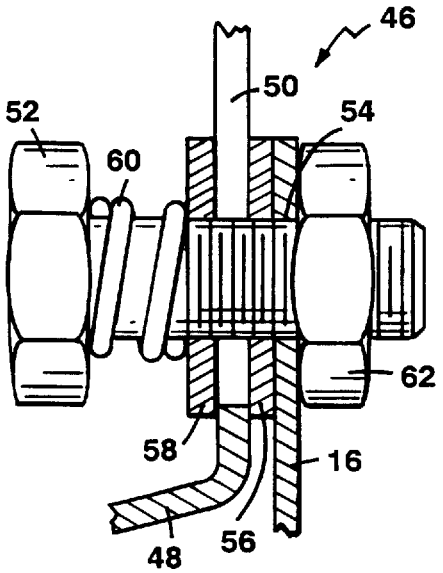
FIG. 8 is a cross-sectional view of a tension screw of the light fixture.

As shown in FIG. 8, friction assembly 46 includes a bolt 52 that extends through both slot 50 and a hole 54 in the top of curved wall 16. A first washer 56 is disposed between wall 16 and guide plate 48, and a second washer 58 is disposed between a compression spring 60 and guide plate 48. A nut 62 secures bolt 52 in place. Washers 56, 58, which are made of a relatively soft material, e.g., a plastic such as nylon, curved wall 16 from contacting guide plate 48. Because they are made of a softer material than any of these items, washers 56, 58 serve as bearings that reduce wear as wall 16 moves with respect to guide plate 48.

Figure 9:
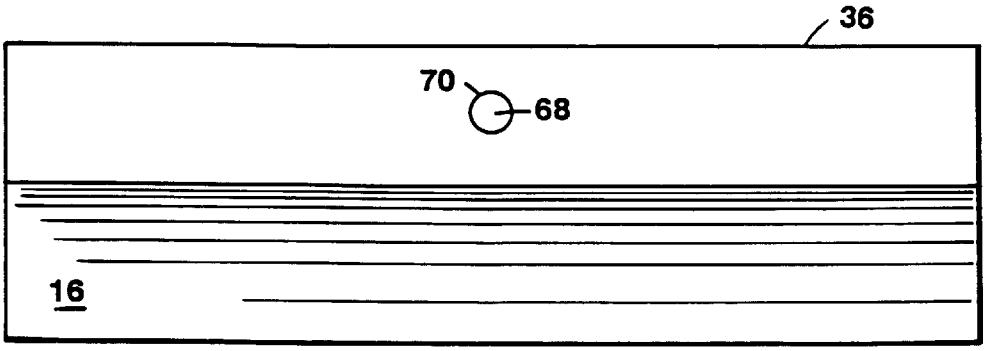
FIG. 9 is a schematic back view of the light fixture in the rotational orientation shown in FIG. 1.

In operation, to change the direction of illumination of light fixture 10, a user grasps the edge 64 of curved wall 16 (FIGS. 2 and 4), which is provided with a lip 66 for this purpose, and pushes or pulls lamp assembly 14 until the desired direction of illumination is achieved. Thus, for example, to illuminate the region directly below fixture 10, lamp assembly 14 is rotated upward until it is fully recessed, as depicted in FIGS. 3 and 4. If instead the user wishes to illuminate a vertical surface, e.g., a wall (not shown), near fixture 10, he or she would rotate lamp assembly 14 downward until the desired illumination effect is achieved. As shown in FIG. 9, curved wall 16 acts as a shield to direct the illumination in the desired direction.

Because friction assembly 46 travels in slot 50 of guide plate 48 as lamp assembly 14 is rotated, the arc length of slot 50 determines the range of rotation of lamp assembly 14. For example, this range may span from 0 to 60 degrees. The user can rotate lamp assembly 14 to any angle within this range of rotation. If friction assembly 46 is adjusted properly, the frictional force between washers 56, 58 and guide plate 48 maintains lamp assembly 14 in the desired rotational orientation.

If the frictional force between washers 56, 58 and guide plate 48 is too great, lamp assembly 14 may be difficult to rotate. Alternatively, if the frictional force is too low, lamp assembly 14 may rotate downward under the force of gravity alone. Should either be the case, an access plug 68, e.g., a round rubber plug inserted into a hole 70 in the back of housing 36 (FIGS. 2, 4, and 9), may be removed to provide access to friction assembly 44. Bolt 52 may then be loosened or tightened to vary the loading on spring 50, changing the frictional force between washers 56, 58 and guide plate 48.

Other embodiments are within the claims.

Figure 10:
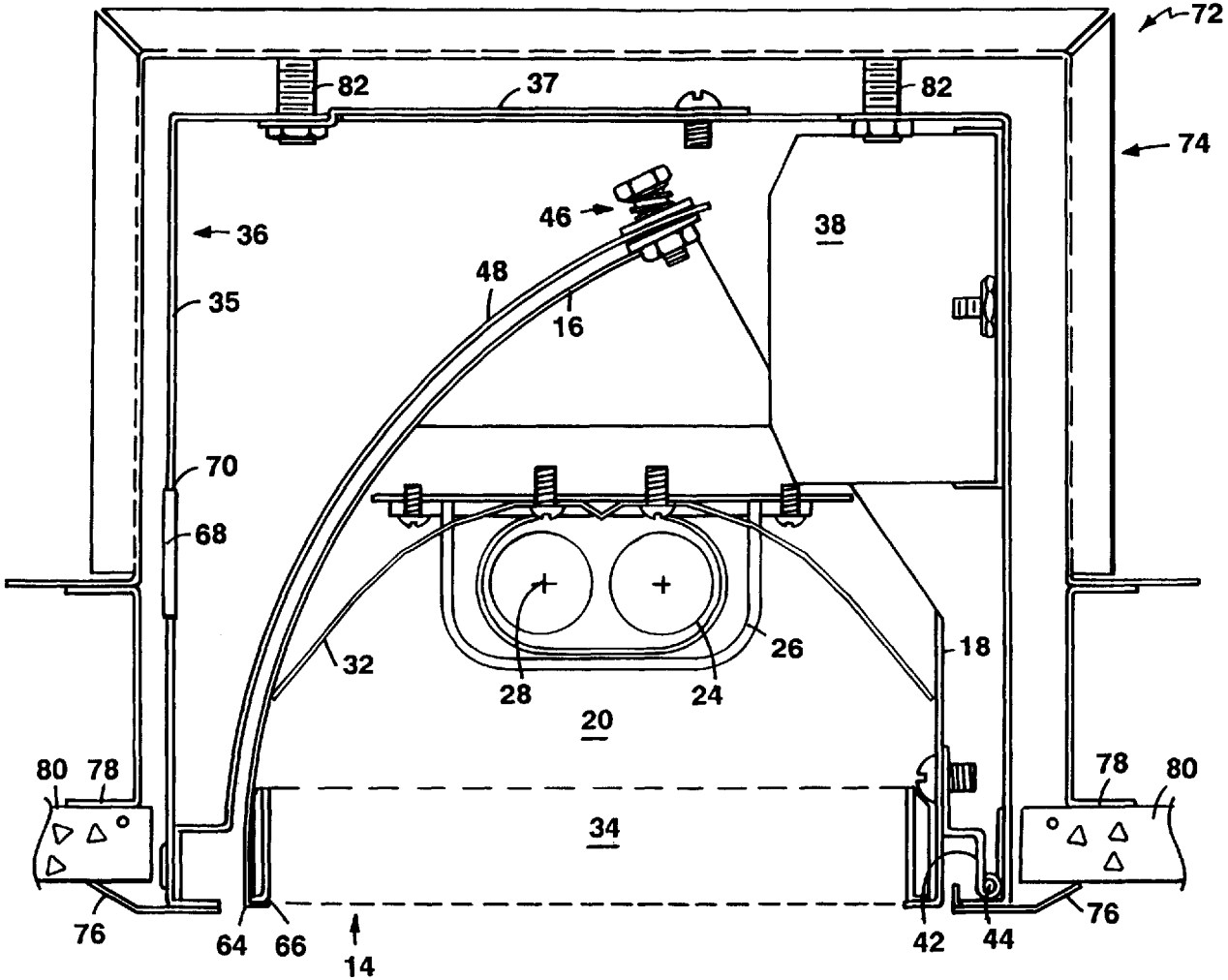
FIG. 10 is a cross-sectional view of another light fixture embodiment.

For example, a second adjustable light fixture 72 is shown in FIG. 10, with lamp assembly 14 fully rotated into housing 36. Light fixture 72 is identical to light fixture 10, except t-bar clips 39 have been replaced by an adjustable flange unit 74. Flange unit 74, which includes a pair of fixed lower support flanges 76 and a pair of adjustable upper flanges 78, allows light fixture 72 to be installed in a ceiling 80 of sufficient strength and integrity to support fixture 72 (e.g., a sheet rock ceiling). Lower support flanges 76 are placed against the exposed surface of ceiling 80, and adjustment screws 82 are turned until upper support flanges 78 are secure against the unexposed surface of ceiling 80.

Light fixtures 10, 72 need not be mounted in ceilings, but can be mounted in walls or other structures instead. Moreover, guide plate 48 need not be a curved bracket with a straight slot, as described above. For example, if the guide plate were located adjacent end sections 20 of lamp assembly 14, it could be a flat bracket with a curved slot.

Figure 11:
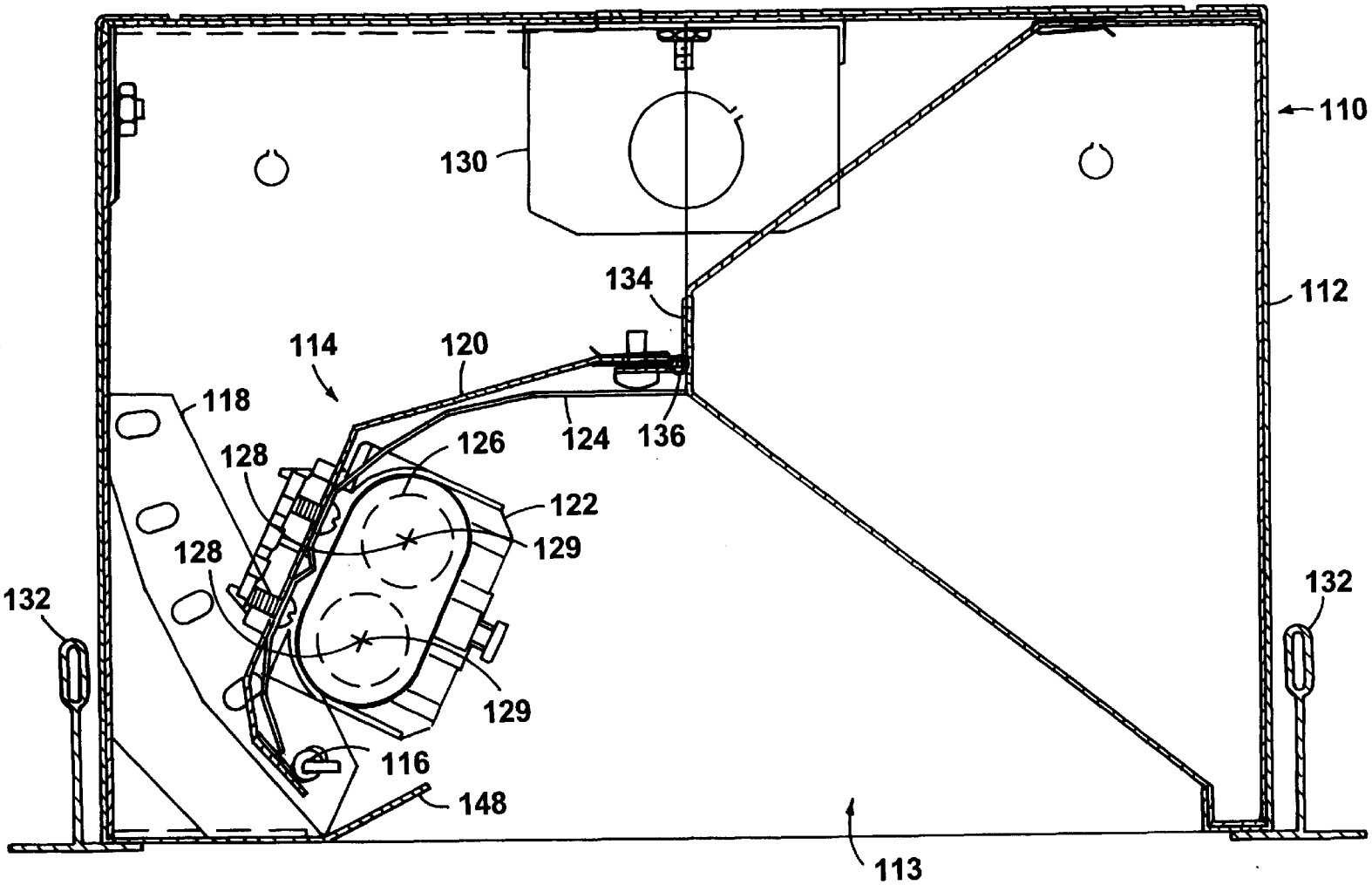
FIG. 11 is a cross-sectional view of another light fixture.
Figure 12:
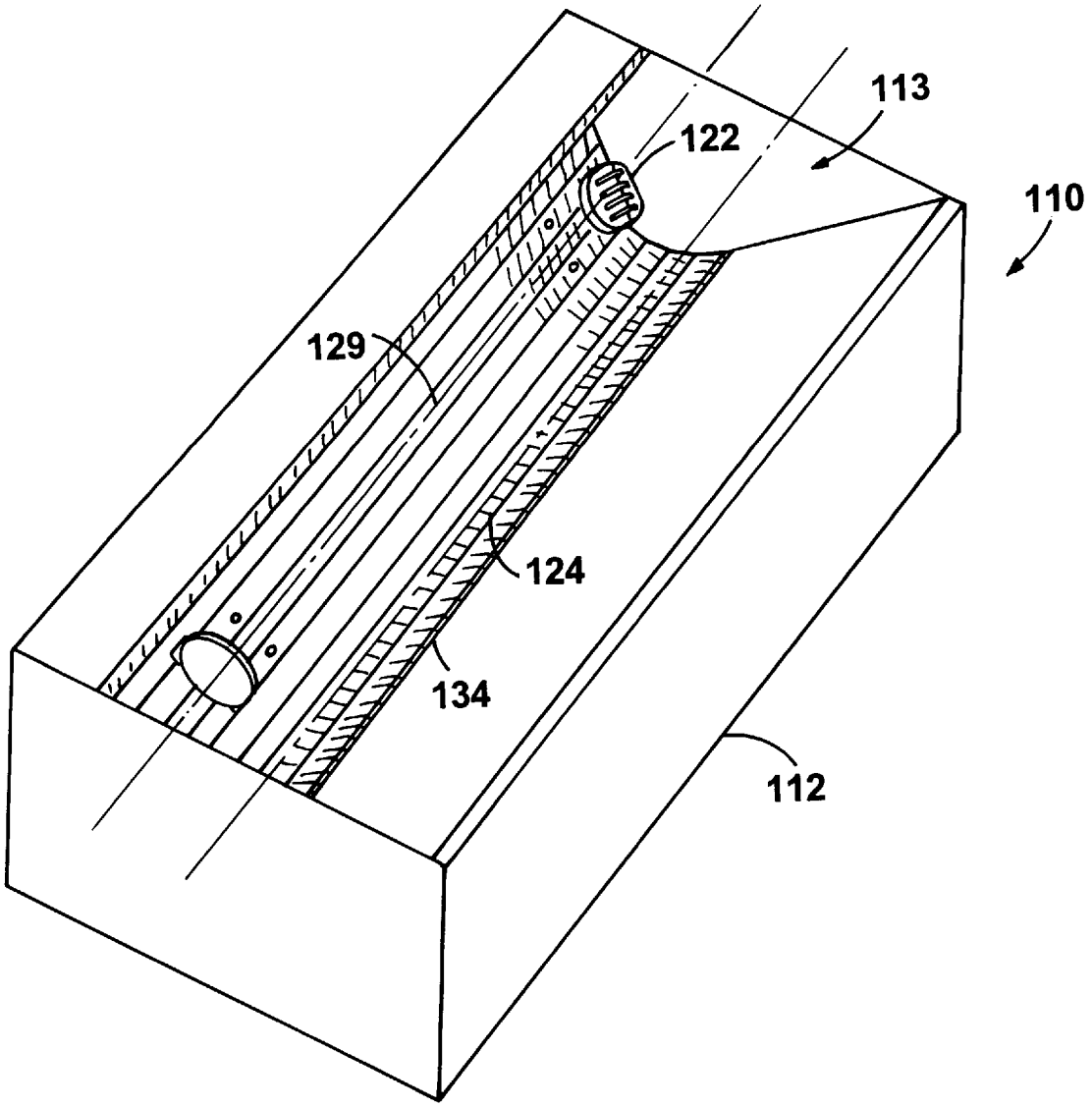
FIG. 12 is a perspective view of the light fixture of FIG. 11, with the lamp removed.

Referring to FIGS. 11 and 12, another adjustable light fixture 110 includes a fixture housing 112, similar in construction to fixture housing 36, with an opening 113. A lamp assembly 114 in light fixture 110 may be rotated with respect to housing 112 and opening 113. Lamp assembly 114 includes an elongated lamp 126 (not shown in FIG. 12), such as a 40 watt biaxial fluorescent lamp with two parallel bulbs. Multiple lamps, or lamps with only a single bulb, can instead be used. Lamp 126 is installed in a lamp socket 122 bolted to a support shroud 120 and an elongated reflector 124 (i.e. the length of reflector 124 is greater than its width). Socket 122 is oriented such that the longitudinal axes 128 of the two bulbs in lamp 126 are aligned at or near focal lines 129 of reflector 124. Reflector 124 directs illumination from energized lamp 126 out of opening 113.

Housing 112, which in this embodiment fully encloses lamp assembly 114, comprises an elongated box, generally rectangular in cross-section, that is closed at its ends and three of its four sides. Housing 112 is constructed of a rigid material, e.g., 20 GA steel. A ballast unit 130 connected by a cable (not shown) to lamp socket 122 supplies power to energize lamp 126. Ballast unit 130 is mounted (e.g., by bolts) to the inside wall of housing 112, and therefore its weight does not affect the rotation of lamp assembly 114. When installed into a ceiling (not shown), light fixture 110 rests on T-bars 132 that also support suspended ceiling tiles.

A hinge 134 extends nearly the full length of lamp fixture 110, allowing lamp assembly 114 to be rotated about an axis 136 with respect to housing 112 to change the direction of illumination projecting out of opening 113. Hinge 134 (e.g., a continuous 18 GA piano hinge) is bolted to the edge of shroud 120 of lamp assembly 114, and welded to housing 112. The axis of rotation 136 of lamp assembly 114 is generally parallel to and spaced apart from the longitudinal axes 128 of the bulbs of lamp 126 and the focal lines 129 of reflector 124. Lamp assembly 114 thus sweeps out an arc as it rotates, moving lamp 126 and reflector 124 through a wide range of rotational orientations with respect to housing 112. A lip 148 on housing 112 serves as a stop to engage the lower corner of shroud 120, preventing lamp assembly 114 from rotating out of housing 112 through opening 113. In all of its rotational orientations, then, lamp assembly 114 remains fully enclosed by housing 112. Lip 148 also serves as a light shield for directing illumination out of opening 113.

Figure 14A:
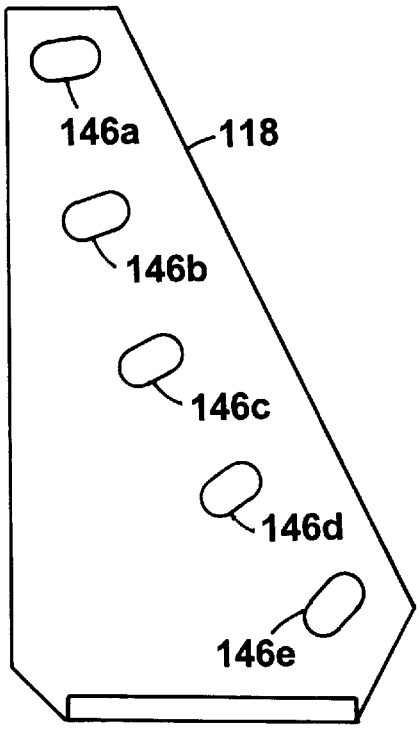
FIG. 14*a* is a front view of an engagement plate for the latching assembly of FIG. 13.
Figure 14B:
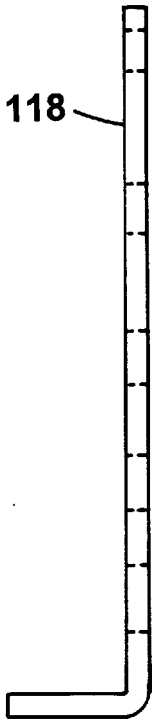
FIG. 14*b* is a side view of the engagement plate of FIG. 14*a*.
Figure 13:
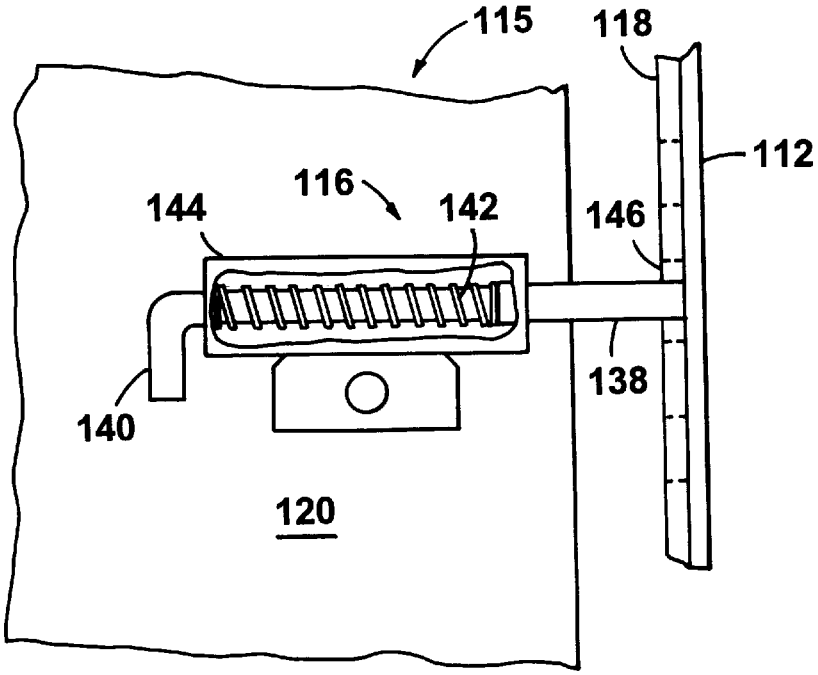
FIG. 13 is a front view of a latching assembly of the light fixture of FIG. 11.

Referring also to FIGS. 13, 14*a*, and 14*b*, the rotational orientation of lamp assembly 114 with respect to housing 112 can be fixed by a latching assembly 115. Latching assembly 115 includes a spring-loaded pin assembly 116 welded to shroud 120 and an engagement plate 118 welded to the side of housing 112. Spring-loaded pin assembly 116 (available from Rijon Mfg. Co. Inc., 13733 Chatham Street, Blue Island, ILL.) includes a pin 138 with an integral handle 140, a spring 142, and a housing 144. Spring 142 is preloaded to bias pin 138 toward engagement plate 118, and pin 138 can be disengaged from the plate by pulling back on handle 140. As shown in FIG. 14*a*, engagement plate 118 includes a series of spaced holes 146*a*–146*e* sized and configured to receive pin 138.

In operation, lamp assembly 114 can be moved to change the direction of illumination by reaching in through opening 113 to access latching assembly 115. Handle 140 is first pulled back to withdraw pin 138 from its current hole 146*a*–146*e* in engagement plate 118. Lamp assembly 114 is then rotated to the desired orientation, and pin 138 is released to seat in a new hole. If pin 138 fails to align with a hole, lamp assembly 114 can be rotated either up or down slightly until the pin seats. In the event the user tries to rotate lamp assembly 114 downward past the lowermost hole 146*e*, lip 148 prevents lamp assembly 114 from pivoting through opening 113.

Figure 15:
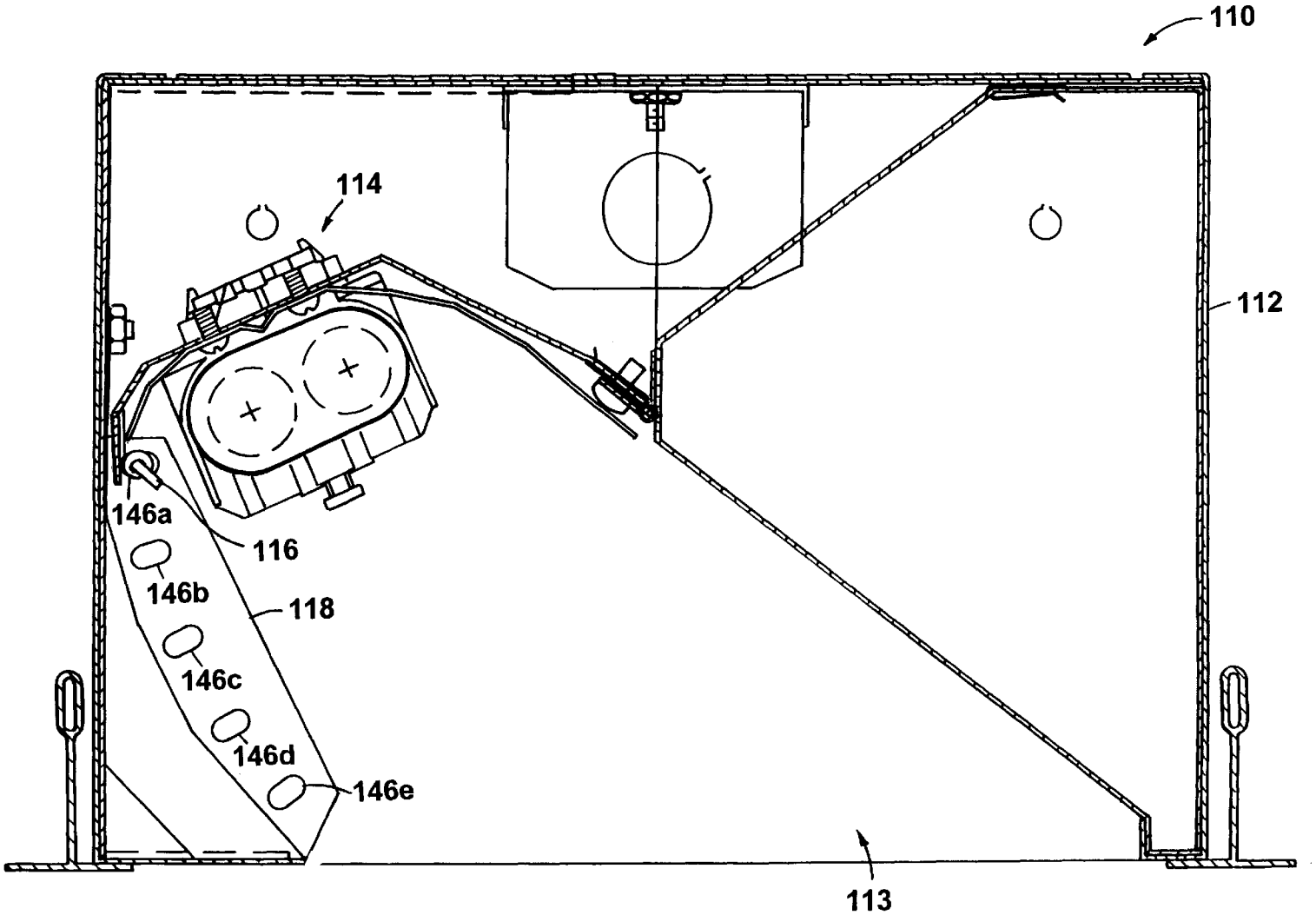
FIG. 15 is a cross-sectional view of the light fixture of FIG. 11, with the lamp assembly in the uppermost position.

Each hole 146*a*–146*e* corresponds to a discrete rotational orientation of lamp assembly 114 with respect to housing 112. For instance, in the orientation shown in FIG. 11, pin 138 is seated in hole 146*e*. Rotated to its uppermost rotational orientation, as shown in FIG. 15, pin 138 seats in hole 146*a*.

Figure 16:
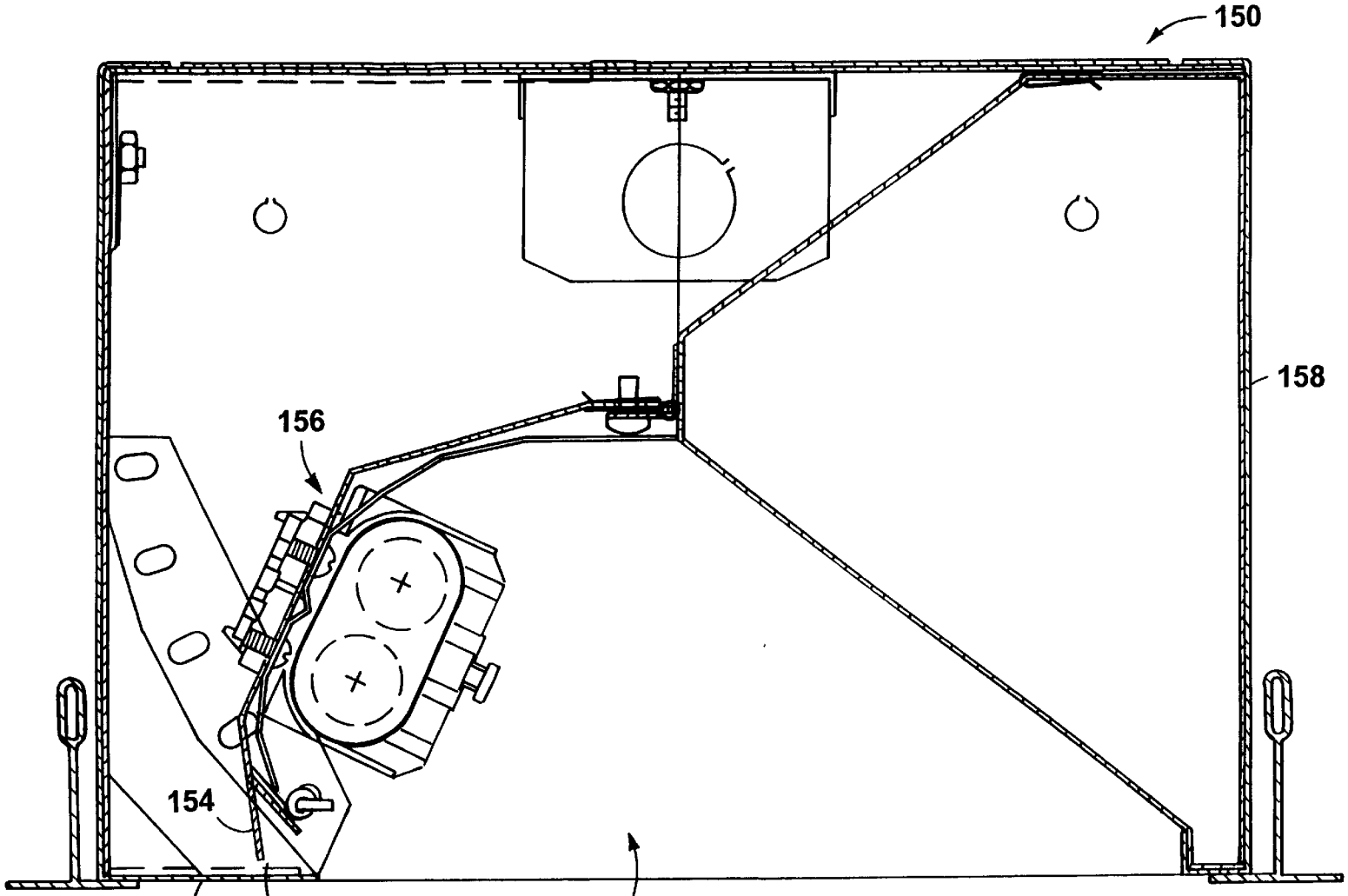
FIG. 16 is a cross-sectional view of another light fixture.

Structures other than lip 148 (FIG. 11) can be used to prevent lamp assembly 114 from rotating out of housing 112 through opening 113. For instance, as shown in FIG. 16, the shroud of a lamp assembly 156 (similar to lamp assembly 114) can be provided with a projection 154 sized and configured so that the end 152 of the projection contacts the inside wall of the fixture housing 158 to prevent the lamp assembly from rotating through an opening 160 in the housing.

Figure 17:
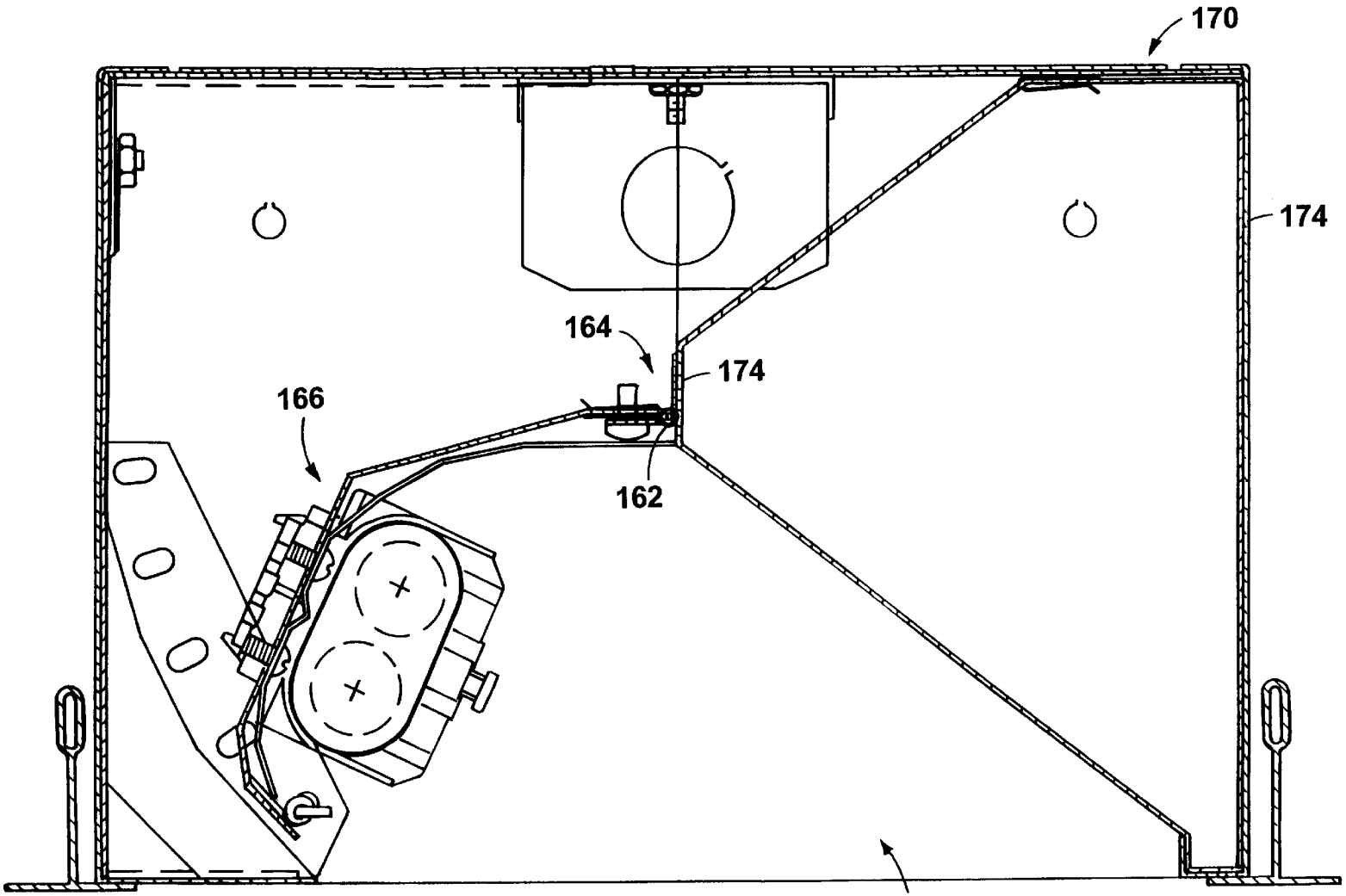
FIG. 17 is a cross-sectional view of another light fixture.
Figure 18A:
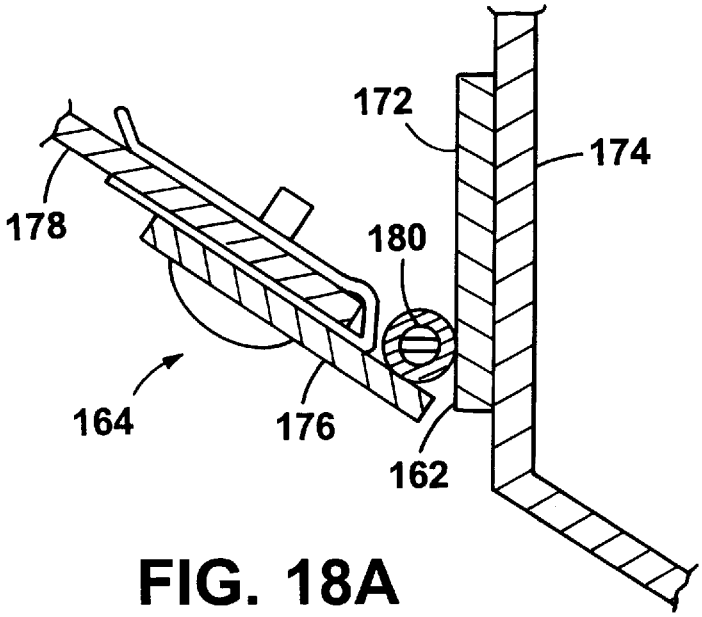
FIGS. 18*a* and 18*b* are cross-sectional views of a hinge of the light fixture of FIG. 17.
Figure 18B:
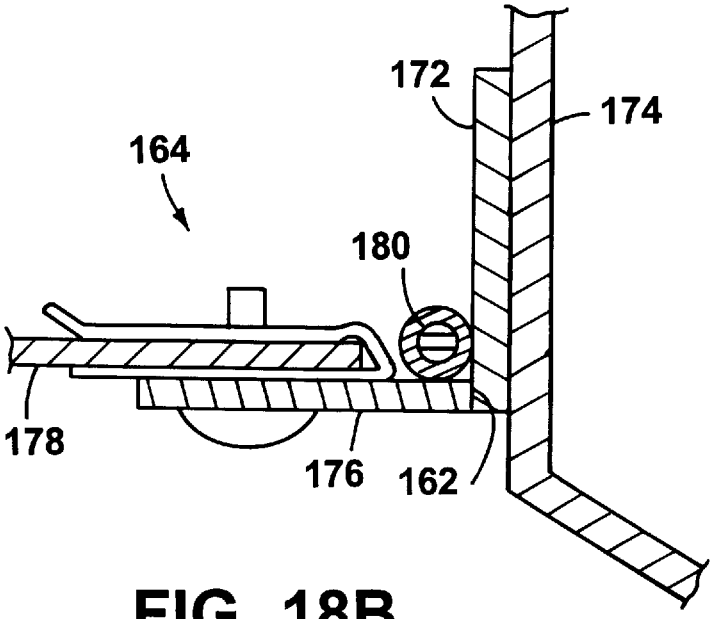

Referring to FIGS. 17, 18*a* and 18*b*, a rotation-limited hinge 164 can also be used to prevent a lamp assembly 166 from rotating through an opening 168 in the housing 174 of a light fixture 170. One plate 172 of hinge 164 is welded to housing 174, and the other plate 176 is bolted to a shroud 178 of lamp assembly 166. A hinge pin 180 couples plates 172, 176, allowing them to rotate with respect to one another. A section 162 of plate 172 projects beyond the point of rotation defined by pin 180, and is configured to engage the end of hinge plate 176 as it rotates from the position shown in FIG. 18*a* to the position shown in FIG. 18*b*. By limiting the rotation of hinge 164, section 162 prevents lamp assembly 166 from moving through opening 168.

Alternatively or additionally, a cable (not shown) may be connected between the lamp assembly and the fixture housing to limit the rotation of the lamp assembly with respect to the housing, and to prevent the assembly from rotating through an opening in the housing.

Alternatively or additionally, the structure of latching assembly 115 (FIG. 15) can be "reversed." Instead of a plate with holes, a series of spring loaded pins can be arranged along a wall of the fixture housing so as to engage a mating hole in the lamp assembly as the lamp assembly is rotated.

Still other embodiments are within the claims.

What is claimed is:

1. A light fixture comprising:

a mounting structure defining an opening;

a lamp assembly including an elongated lamp extending along an axis and an elongated reflector, the lamp assembly being oriented inside the mounting structure to direct illumination out of the opening when the lamp is energized;

a coupling between the mounting structure and the lamp assembly, the coupling being configured to permit the lamp assembly to pivot with respect to the mounting structure about an axis parallel to and spaced apart from the axis of the elongated lamp; and a stop carried by the mounting structure, the stop being configured to prevent the lamp assembly from pivoting through the opening in the mounting structure.

2. The light fixture of claim 1 wherein the stop comprises a region of the mounting structure.

3. The light fixture of claim 2 wherein the stop comprises a region of the mounting structure disposed adjacent the opening.

4. The light fixture of claim 2 wherein the lamp assembly is configured to engage the region of the mounting structure.

5. The light fixture of claim 1 wherein the coupling comprises a hinge.

6. The light fixture of claim 5 wherein the stop comprises a region of the hinge.

7. The light fixture of claim 1 wherein the coupling comprises a hinge pin.

8. The light fixture of claim 7 wherein a first hinge plate attached to the mounting structure and a second hinge plate attached to the lamp assembly are rotatably coupled by the hinge pin.

9. The light fixture of claim 8 wherein the stop comprises a region of the first hinge plate.

10. The light fixture of claim 1 further comprising a latching assembly.

11. The light fixture of claim 10 wherein the latching assembly is selectively engageable to fix the orientation of the lamp assembly with respect to the mounting structure at a plurality of predetermined discrete orientations.

12. The light fixture of claim 11 wherein the latching assembly includes a pin movably attached to the lamp assembly.

13. The light fixture of claim 12 wherein the latching assembly includes a series of holes in the mounting structure configured to be engaged by the pin.

14. The light fixture of claim 13 wherein the holes in the mounting structure are regularly spaced.

15. The light fixture of claim 13 wherein the pin is biased towards the series of holes in the mounting structure.

16. The light fixture of claim 10 wherein the latching assembly is selectively disengageable by accessing the latching assembly through the opening.

17. The light fixture of claim 1 wherein the orientation of the lamp with respect to the reflector is fixed.

* * * * *